US010709623B2

(12) United States Patent
Totemeier et al.

(10) Patent No.: US 10,709,623 B2
(45) Date of Patent: Jul. 14, 2020

(54) DOUBLE ROLLER COMPACT PROFILE ACTUATION SYSTEM FOR AN ADJUSTABLE BED

(71) Applicant: ERGOMOTION, INC., Goleta, CA (US)

(72) Inventors: Hunter D. Totemeier, Santa Ynez, CA (US); Brett A. Towe, Goleta, CA (US); Joseph Ermalovich, Santa Barbara, CA (US)

(73) Assignee: ergomotion, inc., Goleta, CA (US)

( * ) Notice: Subject to any disclaimer, the term of this patent is extended or adjusted under 35 U.S.C. 154(b) by 288 days.

(21) Appl. No.: 15/787,587

(22) Filed: Oct. 18, 2017

(65) Prior Publication Data

US 2018/0110665 A1 Apr. 26, 2018

Related U.S. Application Data

(60) Provisional application No. 62/411,369, filed on Oct. 21, 2016.

(51) Int. Cl.

| | |
|---|---|
| ***A61G 7/015*** | (2006.01) |
| ***A61G 7/10*** | (2006.01) |
| ***A61G 7/018*** | (2006.01) |
| ***A47C 20/08*** | (2006.01) |
| ***A47C 20/04*** | (2006.01) |

(52) U.S. Cl.

CPC ..... *A61G 7/015* (2013.01); *A47C 20/041* (2013.01); *A47C 20/08* (2013.01); *A61G 7/018* (2013.01); *A61G 7/1086* (2013.01); *A61G 7/1096* (2013.01)

(58) Field of Classification Search

CPC .... A61G 7/015; A61G 7/1096; A61G 7/1086; A61G 7/018; A47C 20/041; A47C 20/08

USPC ..... 5/618

See application file for complete search history.

(56) References Cited

U.S. PATENT DOCUMENTS

| | | | | | |
|---|---|---|---|---|---|
| 202,936 | A * | 4/1878 | Doll | A61G 7/015 | 5/618 |
| 3,665,528 | A * | 5/1972 | Kjellberg | A47C 20/041 | 5/618 |
| 4,381,571 | A * | 5/1983 | Elliott | A61G 7/015 | 5/616 |
| 4,502,426 | A * | 3/1985 | Skelley | F01L 13/0063 | 123/90.15 |

(Continued)

*Primary Examiner* — Eric J Kurilla
*Assistant Examiner* — James T Coble
(74) *Attorney, Agent, or Firm* — Felix L. Fischer

(57) ABSTRACT

An articulating bed incorporates a support frame with a head end rail, a foot end rail and having side frame rails. An upper body support frame is rotatably connected to a first cross member in the frame. An elevating assembly for the upper body support frame has two angled arms attached to the first cross member with hinges. A first pair of wheels is attached to the angled arms at a vertex and a second pair of wheels attached at an end of the arms distal from the hinges. A first actuator is attached from the head end rail to a cross brace extending between the angled arms. The elevating assembly has a first range of motion in which the first pair of wheels are in contact with longitudinal rails in the upper body support and a second range of motion in which the second pair of wheels are in contact with the longitudinal rails.

14 Claims, 15 Drawing Sheets

(56) References Cited

U.S. PATENT DOCUMENTS

| | | | | |
|---|---|---|---|---|
| 2009/0094748 | A1* | 4/2009 | Long | A47C 20/041 5/613 |
| 2010/0122415 | A1 | 5/2010 | Turner et al. | |
| 2014/0201916 | A1* | 7/2014 | Ermalovich | A61G 7/015 5/618 |
| 2014/0366267 | A1* | 12/2014 | Suh | A47C 20/041 5/174 |
| 2015/0121624 | A1* | 5/2015 | Clenet | A61G 7/015 5/618 |
| 2016/0262549 | A1* | 9/2016 | Rawls-Meehan | A47C 20/041 |

* cited by examiner

DOUBLE ROLLER COMPACT PROFILE ACTUATION SYSTEM FOR AN ADJUSTABLE BED

REFERENCE TO RELATED APPLICATIONS

This application claims priority of U.S. provisional application Ser. No. 62/411,369 filed on Oct. 21, 2016 entitled DOUBLE ROLLER COMPACT PROFILE ACTUATION SYSTEM FOR AN ADJUSTABLE BED the disclosure of which is incorporated herein by reference.

BACKGROUND

Field

This invention relates generally to the field of adjustable beds and more particularly to a structure for an articulating bed having a compact actuation system incorporating a two stage lifting mechanism in an upper body support section employing two roller pairs spaced on angled arms for double leveraged contact with elevating tracks.

Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping.

The mechanical structure and drive mechanisms for such articulating beds must be able to support the weight of both a mattress and the occupant. Due to the size, weight, fabrication materials and configuration of the mattress and supporting structure, maintaining rigidity in the system may also be challenging. Typical articulating beds provide an upper body positioning element and a thigh and lower leg positioning element either individually active or with combined actuation. Articulation of the support elements requires actuators which are typically large and require significant angular orientation for leverage and to avoid "dead spots" created by zero angular leverage or overcenter conditions.

However, designs of modern bedding require a reduced thickness profile in side support elements that exposes the actuation system to view.

It is therefore desirable to provide an articulating bed having a compact profile actuation system adapted to be contained within a reduced thickness profile side support.

SUMMARY

The embodiments disclosed herein overcome the shortcomings of the prior art by providing an articulating bed incorporating a support frame with a head end rail, a foot end rail and having side frame rails. An upper body support frame is rotatably connected to a first cross member in the frame. An elevating assembly for the upper body support frame has two angled arms attached to the first cross member with hinges. A first pair of wheels is attached to the angled arms at a vertex and a second pair of wheels attached at an end of the arms distal from the hinges. A first actuator is attached from the head end rail to a cross brace extending between the angled arms. The elevating assembly has a first range of motion in which the first pair of wheels are in contact with longitudinal rails in the upper body support and a second range of motion in which the second pair of wheels are in contact with the longitudinal rails.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1:
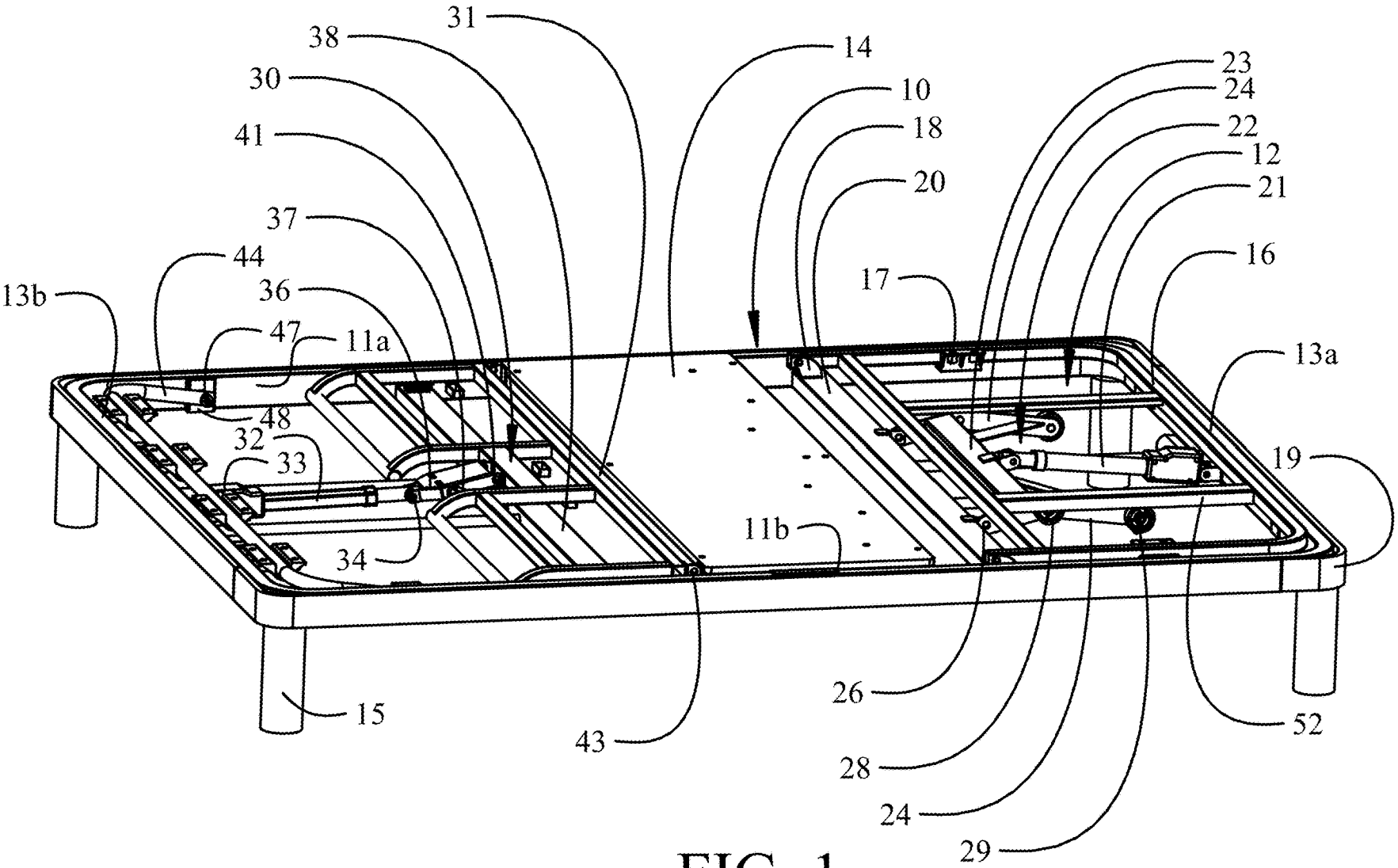
FIG. 1 is a pictorial representation of an embodiment of the ultra-compact profile actuation system with the mattress support removed for clarity.

Embodiments shown in the drawings and described herein provide an actuation system for an articulating bed which may be implemented in a compact vertical space to present a minimum vertical profile for modern bed designs. Referring to the drawings, FIG. 1 illustrates an exemplary embodiment of an adjustable bed incorporating the ultra-compact profile actuation system with the articulating elements of the bed in an unarticulated position. As seen in FIG. 1 in the unarticulated position, a frame 10 having side rails 11*a*, 11*b* and end rails 13*a*, 13*b* carries an upper body articulating structure 12 and a seat support section 14. The frame 10 may be supported by legs 15. The upper body articulating structure includes a support frame 16 which is attached with hinges 18 to a cross frame member 20 extending between the side rails 11*a*, 11*b*. Shuttles 17 engaged on the support frame attach to a flexible mattress support as disclosed in U.S. patent application Ser. No. 13/946,970 having a filing date of Jul. 19, 2013 and entitled ARTICULATING BED WITH FLEXIBLE MATTRESS SUPPORT issued as U.S. Pat. No. 8,910,328 on Dec. 16, 2014 the disclosure of which is incorporated herein by reference. A bolster 19 may surround the frame 10.

An elevating assembly 22 for the upper body support frame 16, to be described in greater detail subsequently, has two angled arms 24 also attached to the cross frame member 20 with hinges 26. A first pair of wheels 28 is attached to the angled arms 24 at a vertex 25. A second pair of wheels 29 is attached at a distal end of the arms 24. A first actuator 21 is attached from the head end rail 13*a* to a cross brace 23 extending between the angled arms 24.

Figure 7A:
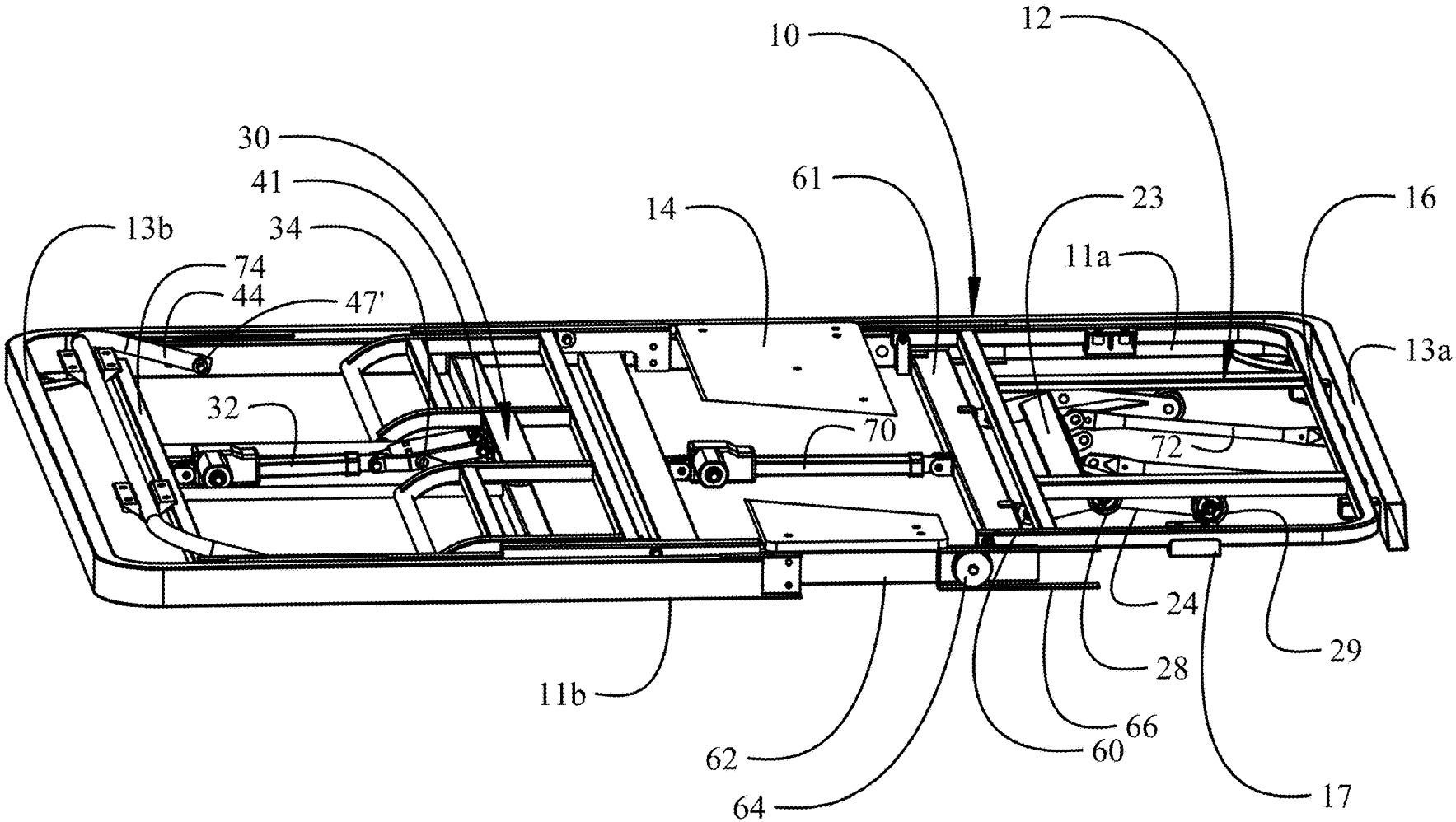
FIGS. 7A and 7B are upper and lower pictorial representations of a "wall hugger" embodiment in an unarticulated position with certain side rail and upper body support elements removed for clarity in carriage structure and the angular arms and wheels and contact with the elevating tracks.
Figure 7B:
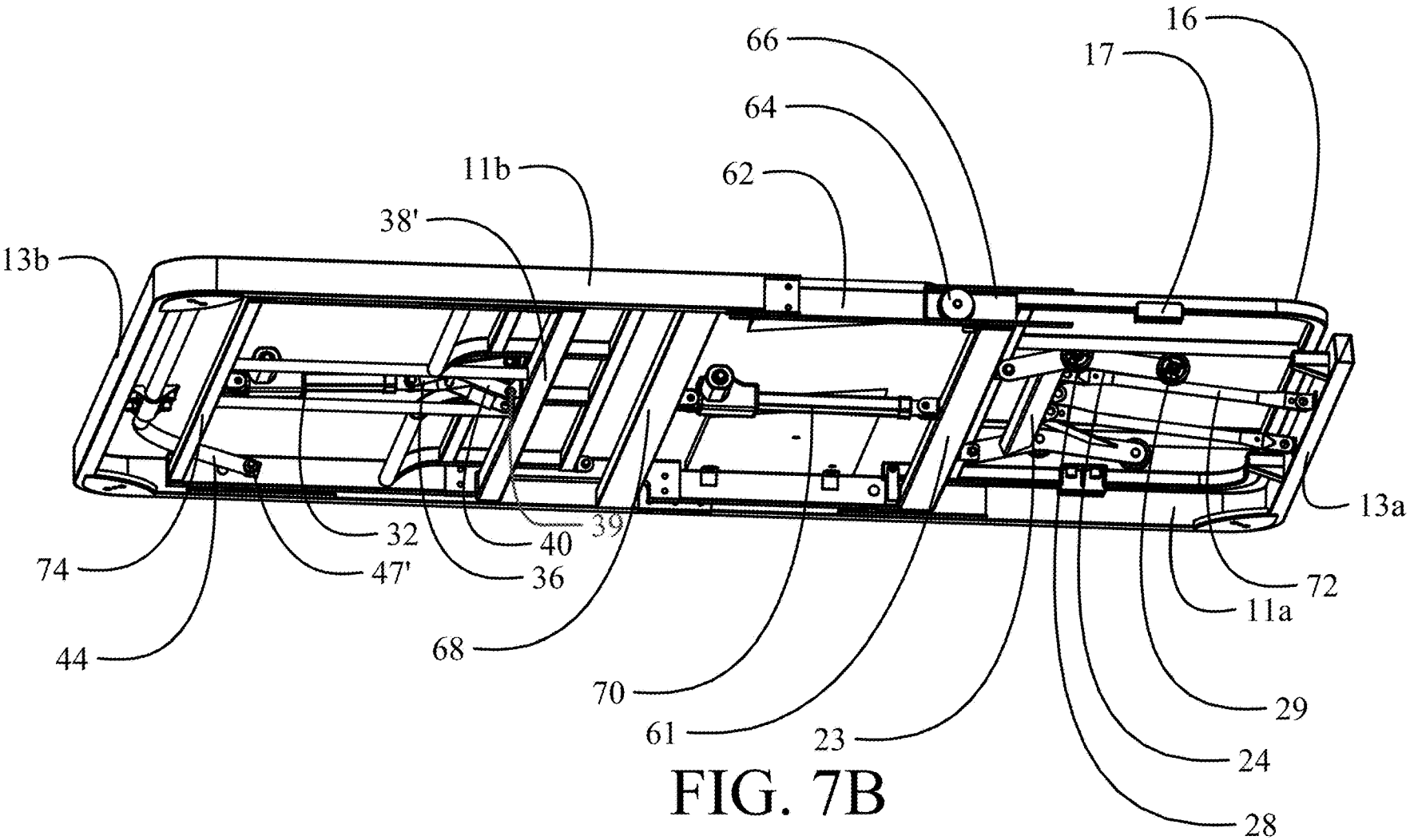

A thigh and lower leg elevation mechanism 30 is actuated by a second actuator 32 attached to the foot end rail 13*b* at a first rotation point 33 at a head of the second actuator and a second rotation point 34 at a first end of a first leg 36. Upon extension of the actuator, the first leg 36 is placed in compression to react at a rotation point 37 on a second leg 40. Second leg 40 is attached a second frame cross member 38 at a second rotation point 39 and compression between rotation point 34 and rotation point 39 (seen in FIG. 7B) causes first leg 36 and second leg 40 to cooperatively rotate upward (as best seen in FIGS. 7A and 7B). First leg 36 is attached at a second end to a third rotation point 41 on a thigh support section 42 which rotates about hinges 43 attached a third cross frame member 31. Fixed length reaction rods 44 pivotally attached to the side rails 11*a*, 11*b* at rotation points 47 with brackets 48 cause relative rotation between a thigh portion of the flexible mattress support engaged by the thigh support section 42 and a lower leg support portion. A distal portion 49 of the thigh support section 42 is arcuate to contour the flexible mattress support in the elevated position.

Figure 2A:
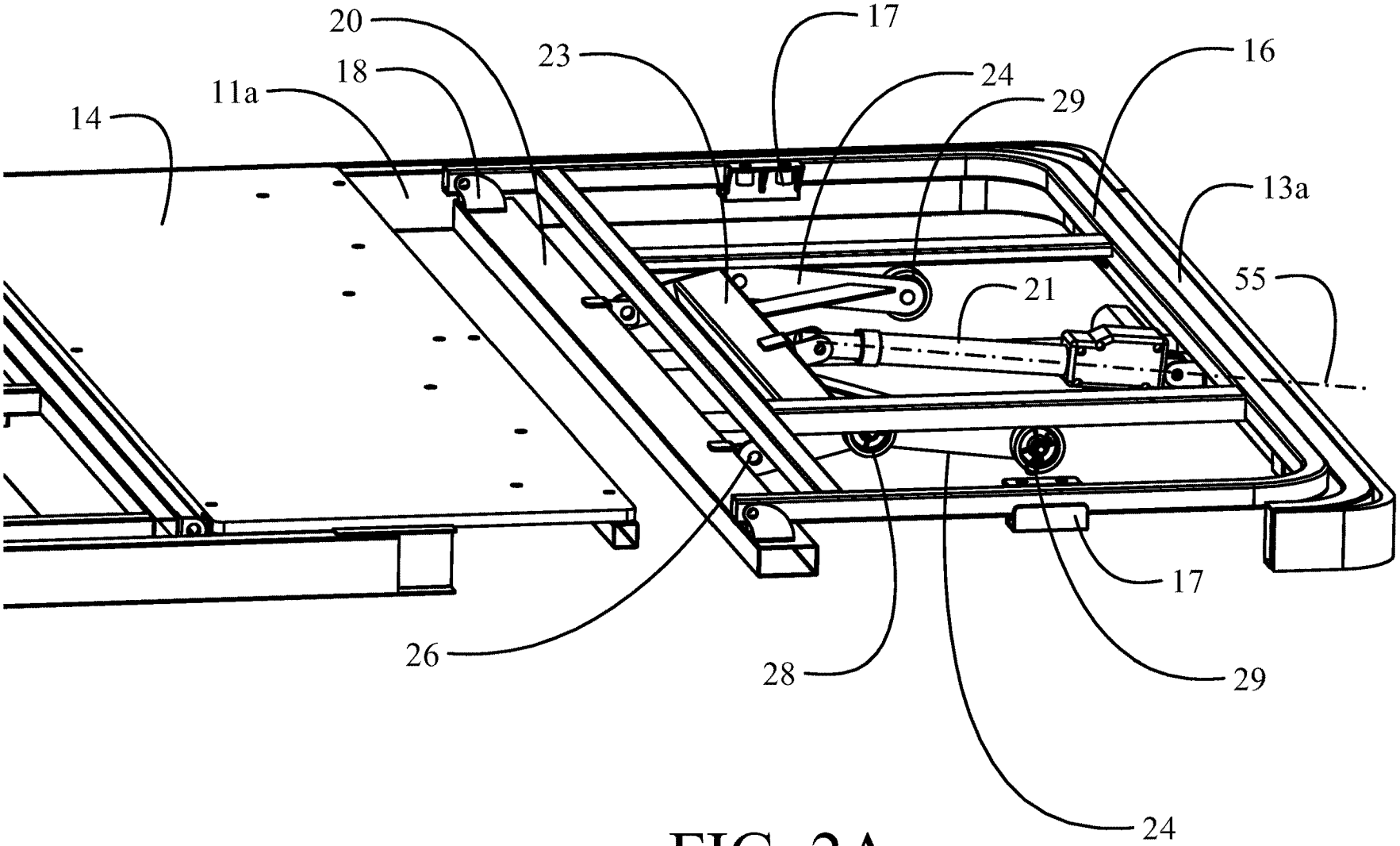
FIG. 2A is the pictorial representation of FIG. 1A with certain side rail and upper body support elements removed for clarity in the angular arms and wheels and contact with the elevating tracks.
Figure 2B:
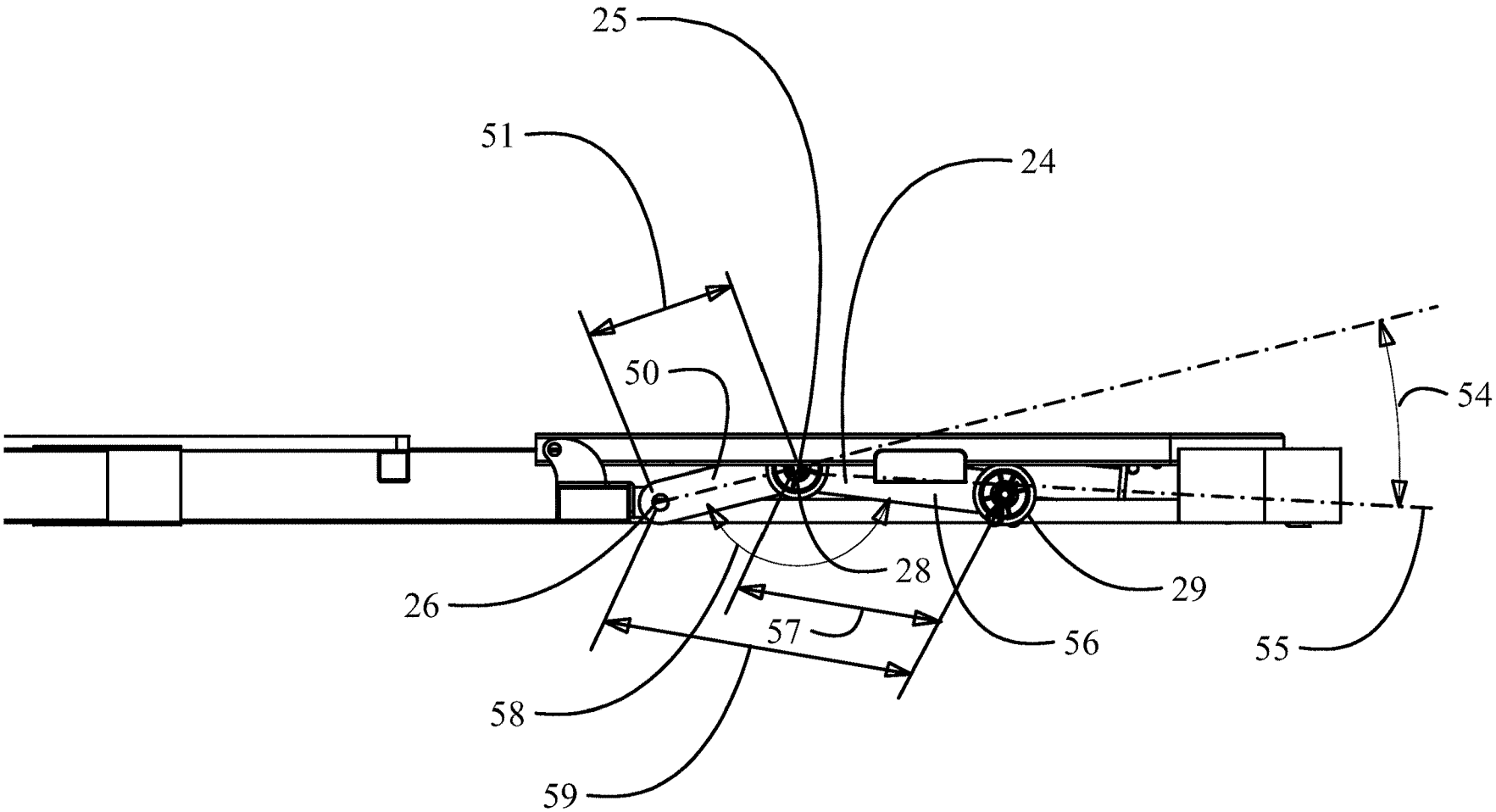
FIG. 2B is a side section view of a portion of the embodiment showing the upper body support structure in the unarticulated position.

Details of the upper body articulating structure 12 and its operation are shown in FIGS. 2A-6B. As seen in FIGS. 2A and 2B with the upper body articulating structure 12 in a flat or unarticulated position, the elevating assembly 22 is in a position in which the angled arms 24 have a first portion 50 which extends from hinges 26 to the vertex 25 at which the first pair of wheels 28 is attached. The wheels 28 engage tracks 52 extending longitudinally in the support frame 16 (the near side track sectioned for clarity). The first portion 50 has a short first length 51 as a first lever arm between the hinges 26 and vertex 25 allows a first engagement angle 54 (best seen in FIG. 2B) between an axis 55 of the first actuator and the first portion 50 significantly larger than would be available for an unangled arm extending from the hinges to the second wheel pair at the end of the arms. This first engagement angle prevents lockup or overcentering of the first actuator 21 and allows leverage for initial rotation of the support frame by extension of the first actuator during articulation as seen in FIGS. 3A and 3B. In the exemplary embodiment the first portion and second portion have a ratio in length of 4/6 with actual lengths of 112 mm and 163 mm. The angle 54 in the exemplary embodiment is 14.5° for a depth of 30 mm for the frame side rails 11*a*, 11*b* to allow the entire actuation assembly to be masked from view in the unarticulated position by the side rails. When the first portion of the lifting assembly is above 12 degrees and the support frame is in a flat position, the overall height of the lifting assembly cannot exceed the profile of the side rails. Additionally, the second portion must allow for sufficient increase of angle in the support frame before engaging the tracks. This must be achieved without extending below the profile of the side rails in the flat position. Furthermore, the second portion must engage the tracks at an angle above 12 degrees.

Figure 3A:
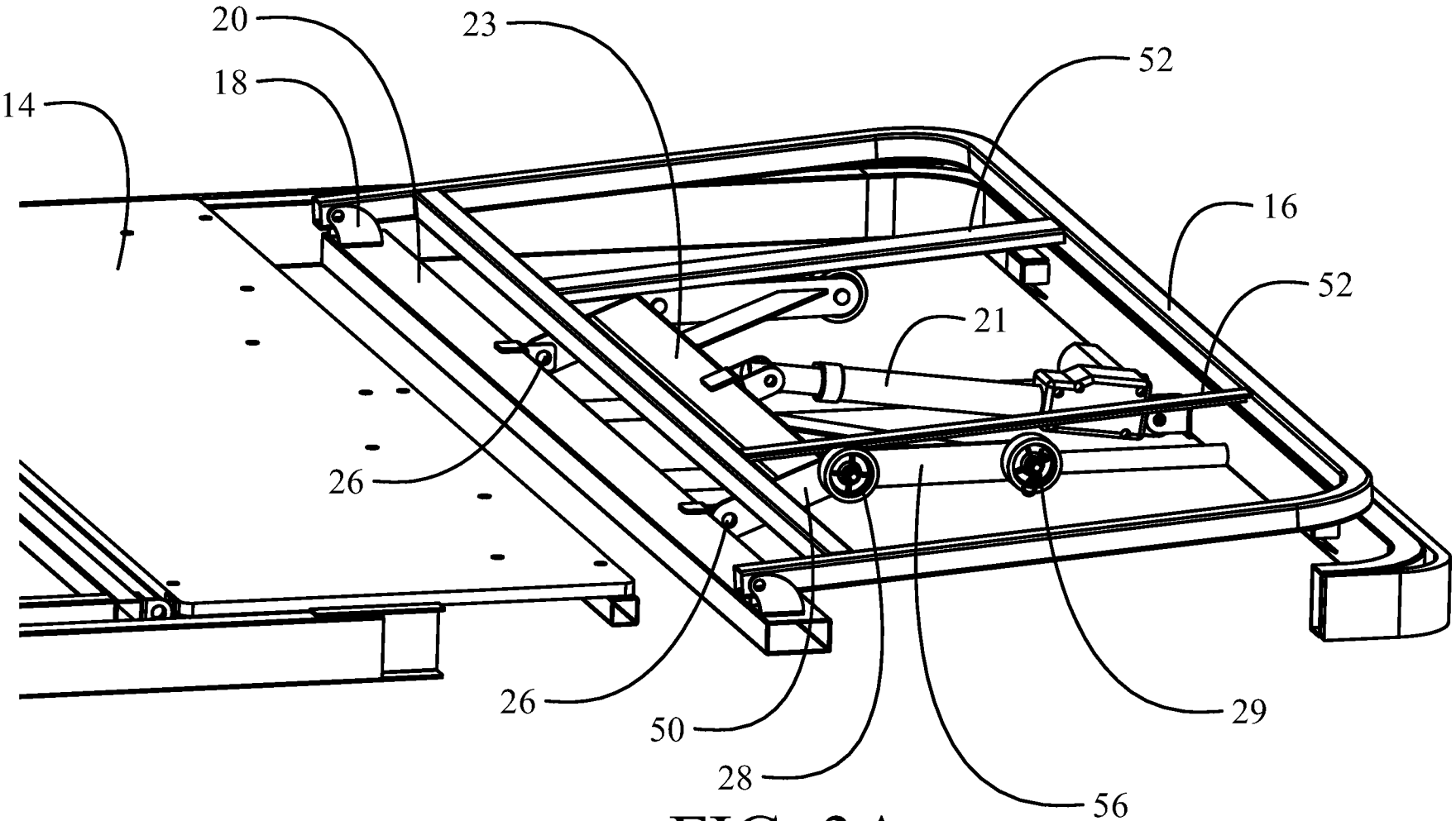
FIGS. 3A and 3B are pictorial and a side views of the embodiment showing the upper body support structure in a first partially articulated position created by the first wheel pair.
Figure 3B:
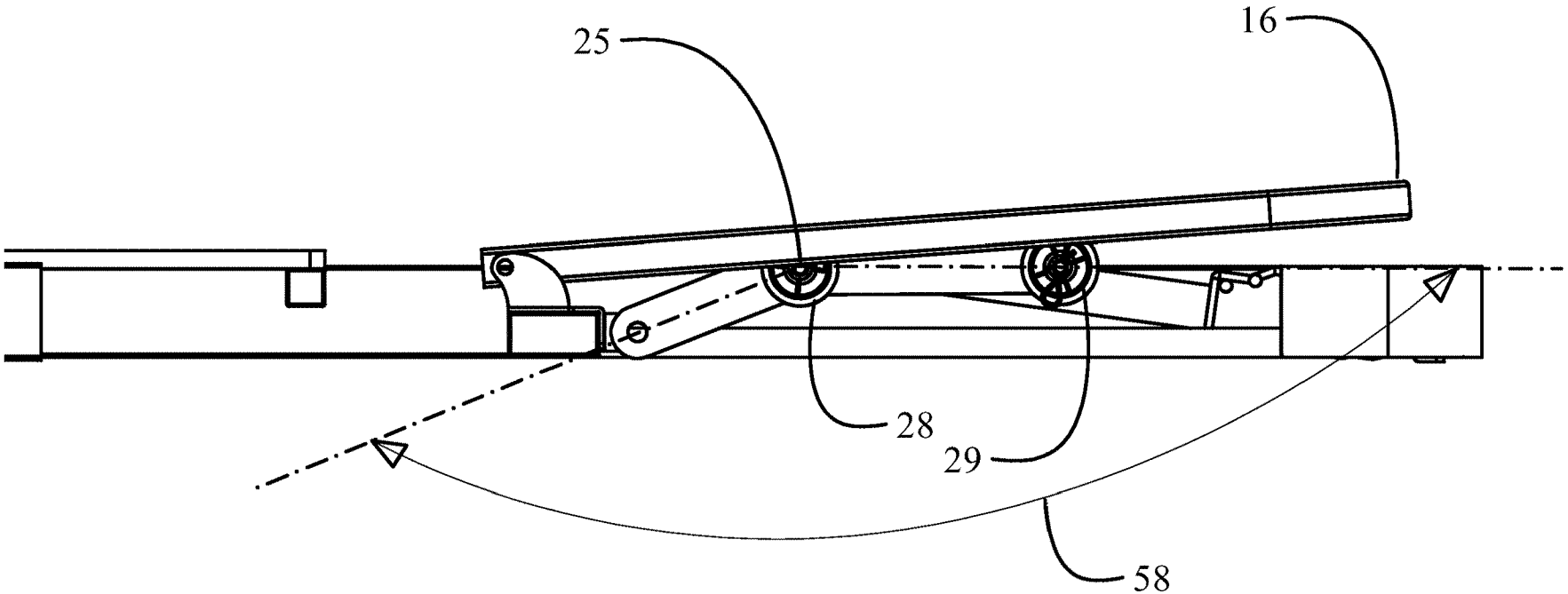
Figure 4A:
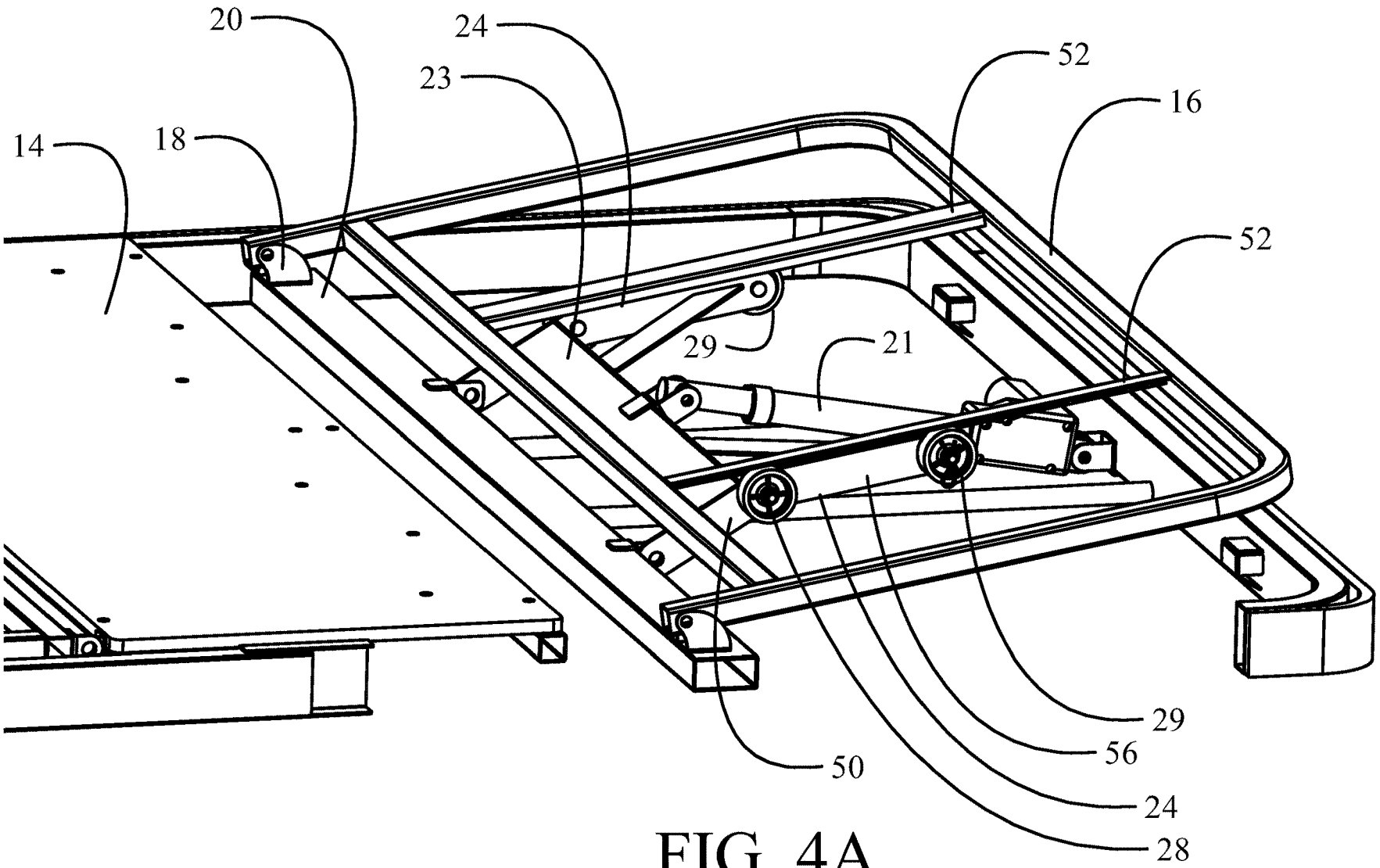
FIGS. 4A and 4B are pictorial and a side views of the embodiment showing the upper body support structure in a second partially articulated position created by the first wheel pair with delayed contact by the second wheel pair.
Figure 4B:
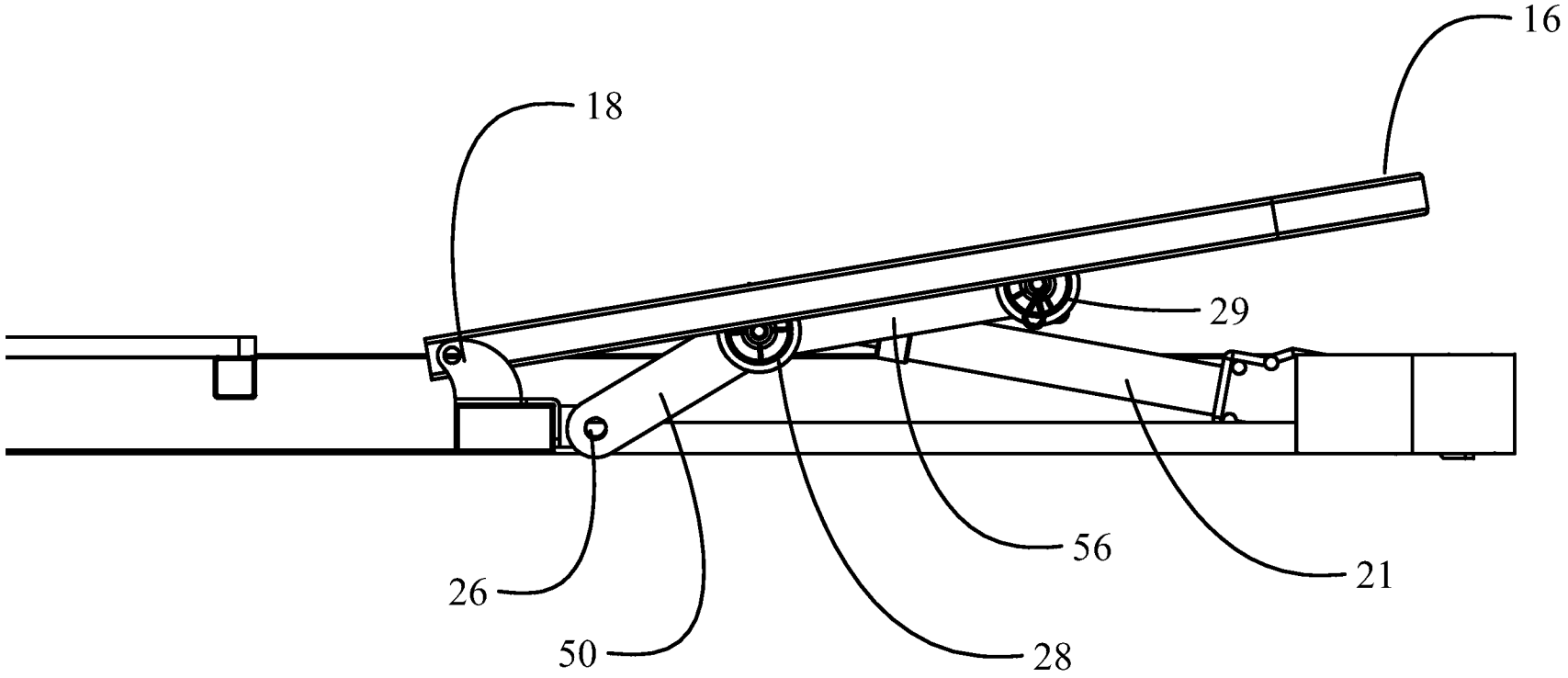
Figure 5A:
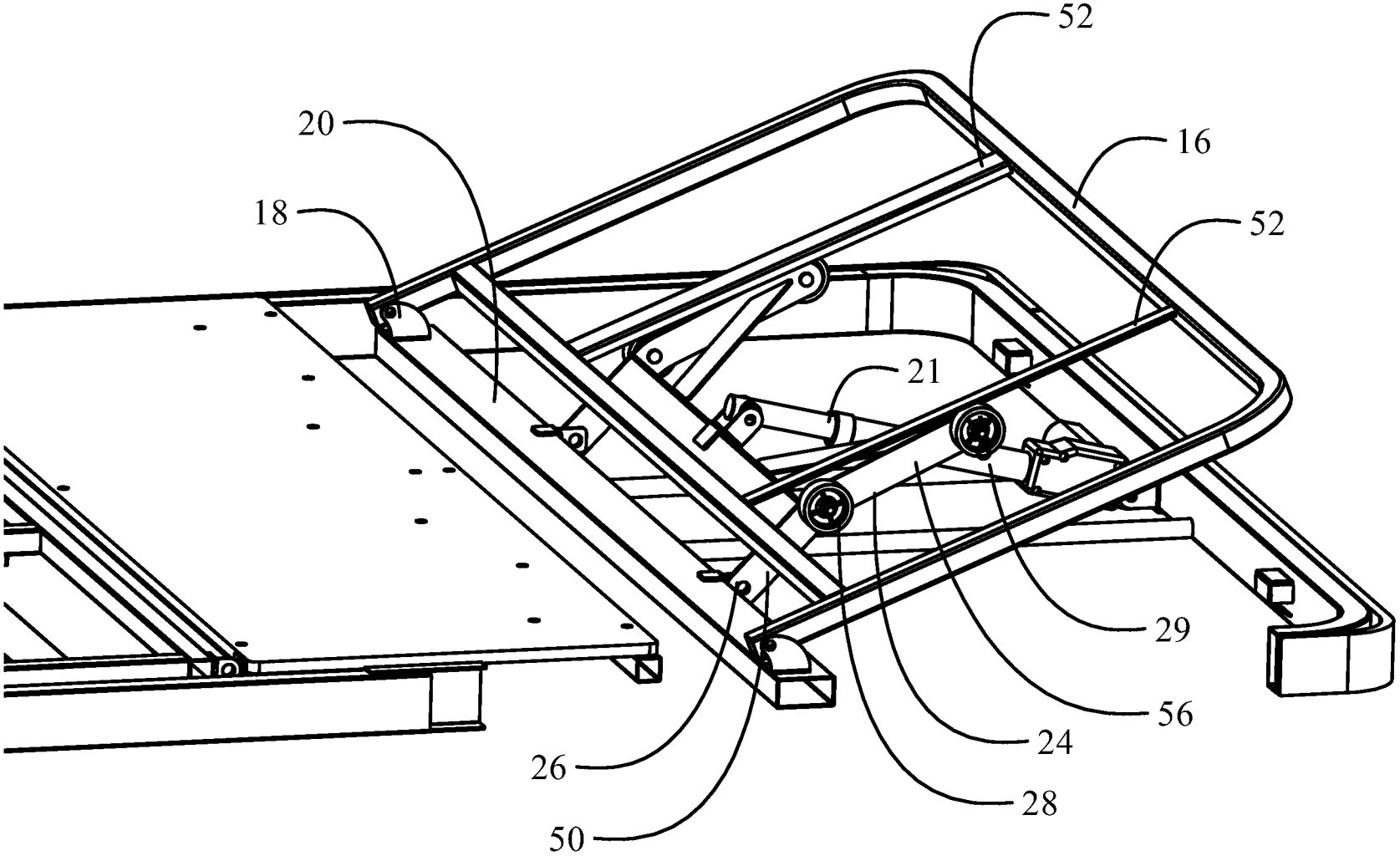
FIGS. 5A and 5B are pictorial and a side views of the embodiment showing the upper body support structure in a third partially articulated position created by the second wheel pair; and, FIGS. 6A and 6B are pictorial and a side views of the embodiment showing the upper body support structure in a fully articulated position created by the second wheel pair.
Figure 5B:
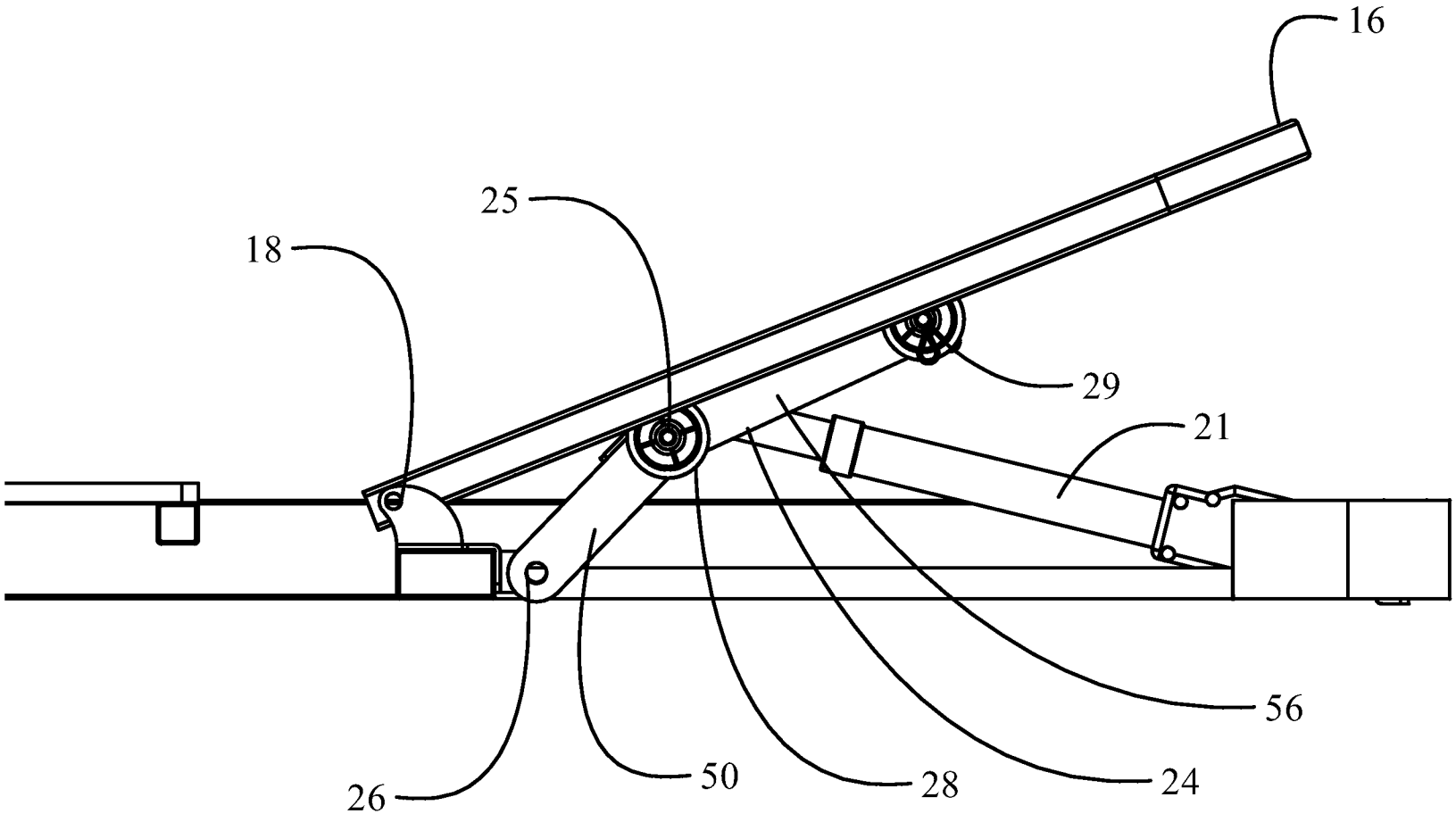

During a first range of motion as represented in FIGS. 3A and 3B, only the first pair of wheels 28 engages the tracks 52 and rotation of the upper body support frame 16 about the hinges 26 is caused by the first wheel pair rolling in the tracks. The second pair of wheels 29 at a distal end of the arms 24 on a second portion 56 extending for a length 57 from the vertex 25 for a second angle 58 between the first portion 50 and second portion 56. At the upper extent of the first range of motion as represented in FIGS. 4A and 4B, the second pair of wheels 29 at the distal end of the arms 24 contact the tracks 52 and begin a second range of motion in which the second pair of wheels 29 roll in the tracks and the first pair of wheels 28 are separated from the tracks as seen in FIGS. 5A and 5B. In the second range of motion a longer lever arm 59 provided by the combination of the first portion 50 and second portion 56 of the arms 24 from the hinges 26 to the second pair of wheels 29 provides enhanced leverage for continuing rotation of the support frame 16 about hinges 18. The second angle 58 may be between 160° and 172° to provide masking but with varying force requirements for the first actuator between the first range and second range of motion.

Figure 6A:
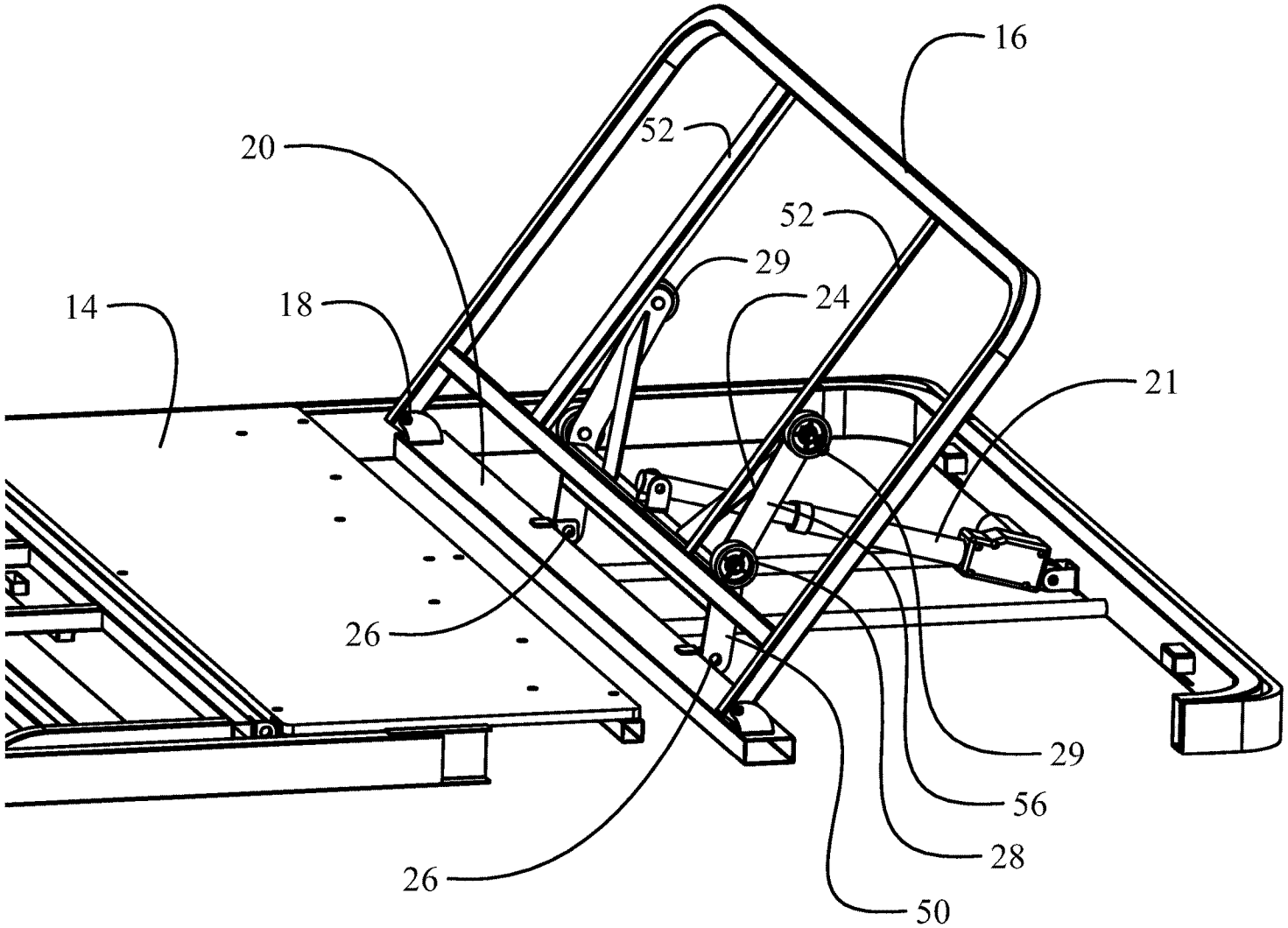
Figure 6B:
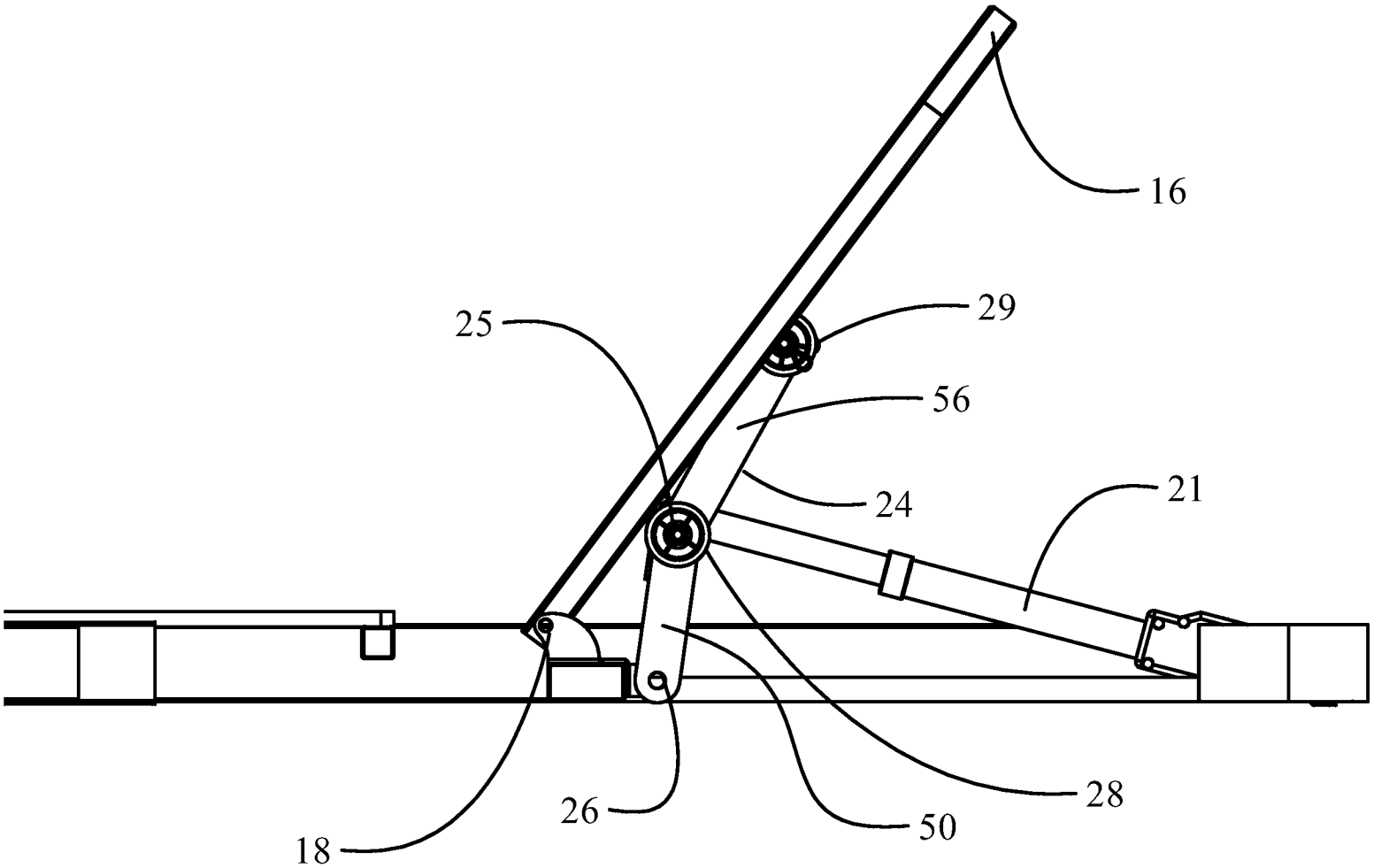

The second range of motion terminates at a desired fully articulated position of the support frame 16 as seen in FIGS. 6A and 6B.

The double roller compact actuation system may also be employed in embodiments for a "wall hugger" articulation system. As shown in FIGS. 7A and 7B in the unarticulated position and FIGS. 8A and 8B in a partially articulated position, the upper body articulating structure support frame 16 is attached with hinges 60 to a head end cross support 61 on a carriage structure 62 which extends between the side rails 11*a*, 11*b* and is supported by wheels 64 engaged in tracks 66 attached to the side rails. As in the prior embodiment, shuttles 17 engaged on the support frame are provided to attach to a flexible mattress support. The seat support section 14 is mounted to the carriage structure 62. A central cross member 68 is fixed between the side rails 11 and an actuator 70 is attached between the central cross member 68 and the head end cross support 61. Extension of the actuator 70 translates the carriage 62 toward the head end rail 13*a*. Reaction rods 72 rotatably attached to the head end rail 13*a* extend to the cross brace 23 extending between the angled arms 24 of the elevating assembly 22. As in the prior embodiment, with the upper body articulating structure support frame 16 in a flat or unarticulated position, the elevating assembly 22 is in a position in which the angled arms 24 have a first portion 50 which extends from hinges 26 to the vertex 25 at which the first pair of wheels 28 is attached. The wheels 28 engage tracks 52 extending longitudinally in the support frame 16. Upon translation of the carriage 62 toward the head end rail 13*a*, the reaction rods 72 are placed in compression thereby rotating the elevating assembly 22 about hinges 60. Operation of the angled arms 24 to sequentially engage the sets of wheels 28 and 29 in the tracks 52 then occurs as previously described.

Figure 8A:
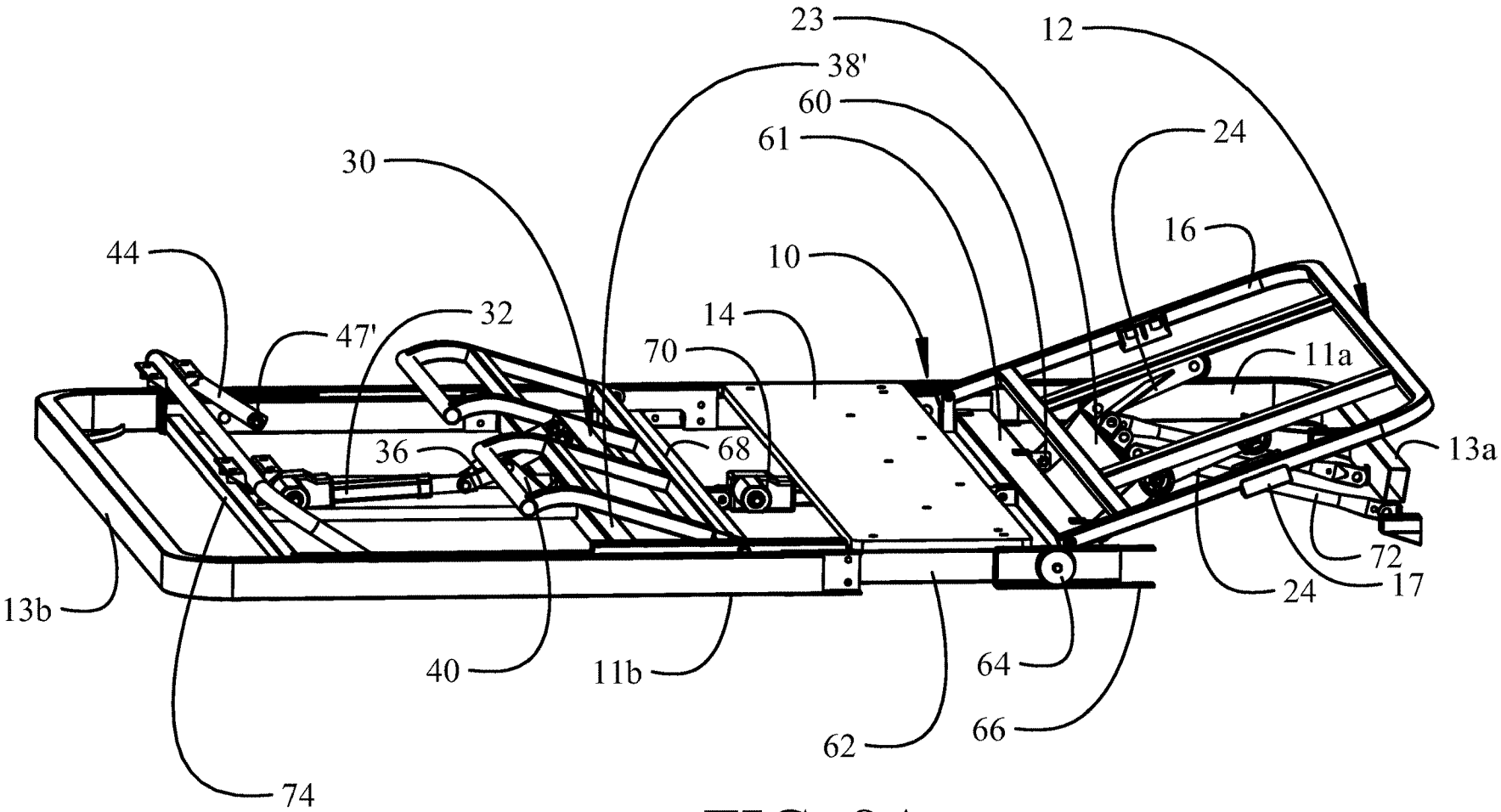
FIGS. 8A and 8B are upper and lower pictorial representation of the "wall hugger" embodiment of FIGS. 7A and 7B in a partially articulated.

As best seen in FIGS. 7A and 8A, the thigh and lower leg elevation mechanism 30 may be supported from the carriage 62 for translation with the carriage. In this embodiment the second actuator 32 is connected between a foot end cross support 74 on the carriage, instead of the foot end rail 13*b*, and the first leg 36 with operation of the thigh and lower leg elevation mechanism as previously described. The second cross frame member 38' is attached for movement with the carriage as opposed to the side rails. The rotation point 47' for the fixed length reaction rods 44 is located on the carriage as opposed to the side rails.

Figure 8B:
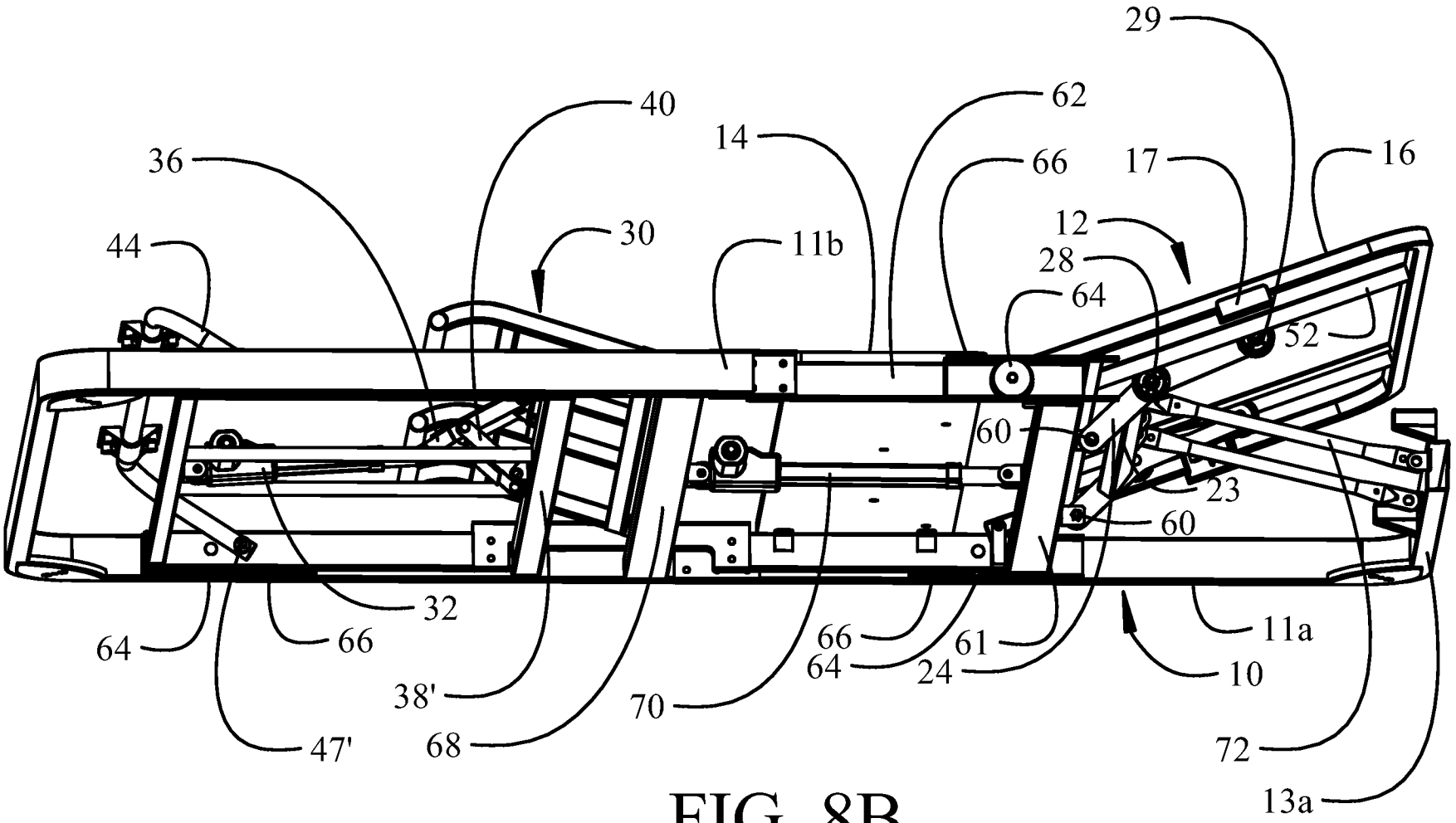

As seen in FIG. 8B, the upper body articulating structure 12 and the thigh and lower leg elevation mechanism 30 provide frames to attach a flexible mattress support. The longitudinal tracks 52 in the support frame 16 provide positive engagement of the wheels of the elevating assembly 22 without engaging the wheels directly on an attached flexible mattress support.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. An articulating bed comprising:

a support frame with a head end rail, a foot end rail and having side frame rails;

an upper body support frame rotatably connected to a first cross member in the frame;

an elevating assembly for the upper body support frame having two angled arms attached to the first cross member with hinges;

a first pair of wheels attached to the angled arms at a vertex;

a second pair of wheels attached at an end of the arms distal from the hinges;

a first actuator attached from the head end rail to a cross brace extending between the angled arms, said elevating assembly having a first range of motion elevating the upper body support frame in which the first pair of wheels are in contact with longitudinal tracks in the upper body support and a second range of motion elevating the upper body support frame in which the second pair of wheels are in contact with the longitudinal tracks, continuing rotation elevating the upper body support frame about the hinges.

2. The articulating bed as defined in claim 1 wherein the angled arms have a first portion extending from the hinges to the vertex and a second portion extending from the vertex to the distal end.

3. The articulating bed as defined in claim 2 wherein the first portion has an initial angle with respect to an extension axis of the first actuator of at least 14.5°.

4. The articulating bed as defined in claim 3 wherein the first portion and second portion have an angle of between 160° and 172°.

5. The articulating bed as defined in claim 4 wherein the length of the first portion is at least 4/6 of the second portion.

6. The articulating bed as defined in claim 1 further comprising:

a second actuator attached to the foot end rail;

a first leg attached at a first end to a rotation point on an extension rod of the actuator;

a second leg connected to the first leg at a rotation point on the first leg, said second leg attached to a cross member of the frame at a second rotation point;

a thigh support section rotatable about hinges attached to the frame and connected to a second end of the first leg at a third rotation point whereby compression of the first leg by the second actuator between the first rotation point and second rotation point causes the first leg and second leg to cooperatively rotate upward, said first leg urging the thigh support section to rotate about the hinges.

7. The articulating bed as defined in claim 6 further comprising:

fixed length reaction rods pivotally attached to the frame at a rotation point;

brackets engaging the fixed length reaction rods to the flexible mattress support, whereby relative rotation is induced between a portion of the flexible mattress support engaged by the thigh support section and a lower leg support portion.

8. A wall hugger articulating bed comprising:

a support frame with a head end rail, a foot end rail and having side frame rails with a central cross member;

a carriage supported from the support frame with wheels and adapted for translation from a first position toward the head end rail to a second position;

an upper body support frame rotatably connected to a head end cross support in the carriage;

an elevating assembly for the upper body support frame having two angled arms attached to the head end cross support with hinges;

a first pair of wheels attached to the angled arms at a vertex;

a second pair of wheels attached at an end of the arms distal from the hinges;

a first actuator attached from the central cross member to the head end cross support, extension of said first actuator translating the carriage from the first position toward the head end rail;

at least one reaction rod rotatably connected between the head end rail and a cross brace extending between the angled arms, said elevating assembly having a first range of motion responsive to translation of the carriage in which the first pair of wheels are in contact with longitudinal rails and elevating the upper body support frame and a second range of motion in which the second pair of wheels are in contact with the longitudinal rails, continuing rotation of the upper body support frame to elevate the upper body support frame about the hinges.

9. The articulating bed as defined in claim 8 wherein the angled arms have a first portion extending from the hinges to the vertex and a second portion extending from the vertex to the distal end.

10. The articulating bed as defined in claim 9 wherein the first portion has an initial angle with respect to an extension axis of the first actuator of at least 14.5°.

11. The articulating bed as defined in claim 10 wherein the first portion and second portion have an angle of between 160° and 172°.

12. The articulating bed as defined in claim 11 wherein the length of the first portion is at least 4/6 of the second portion.

13. The articulating bed as defined in claim 8 further comprising:

a second actuator attached to the foot end rail;

a first leg attached at a first end to a rotation point on an extension rod of the actuator;

a second leg connected to a second end of the first leg at a rotation point, said second leg attached to a cross member of the frame at a second rotation point;

a thigh support section rotatable about hinges attached to the frame and connected to a second end of the first leg at a third rotation point whereby compression of the first leg by the second actuator between the first rotation point and second rotation point causes the first leg and second leg to cooperatively rotate upward, said first leg urging the thigh support section to rotate about the hinges.

14. The articulating bed as defined in claim 13 further comprising:

fixed length reaction rods pivotally attached to the carriage at a rotation point;

brackets engaging the fixed length reaction rods to the flexible mattress support, whereby relative rotation is induced between a portion of the flexible mattress support engaged by the thigh support section and a lower leg support portion.

* * * * *